US005192497A

United States Patent [19]

Sato

[11] Patent Number: 5,192,497

[45] Date of Patent: Mar. 9, 1993

[54] SUPERALLOYS WITH LOW THERMAL-EXPANSION COEFFICIENT

[75] Inventor: Koji Sato, Yasugi, Japan

[73] Assignee: Hitachi Metals, Ltd., Tokyo, Japan

[21] Appl. No.: 844,287

[22] Filed: Mar. 2, 1992

[30] Foreign Application Priority Data

Dec. 18, 1990 [JP] Japan ..... 2-411479

[51] Int. Cl.[5] ..... C22C 38/08; C22C 30/00

[52] U.S. Cl. ..... 420/581; 420/95

[58] Field of Search ..... 420/581, 95

[56] References Cited

U.S. PATENT DOCUMENTS 4,200,459 4/1980 Smith et al. ..... 420/581

FOREIGN PATENT DOCUMENTS 41-2767 2/1966 Japan .
50-30729 3/1975 Japan .
50-30730 3/1975 Japan .
59-56563 4/1984 Japan .
60-128243 7/1985 Japan .
61-23118 1/1986 Japan .
2-70040 3/1990 Japan .
665015 5/1979 U.S.S.R. ..... 420/581
691148 5/1953 United Kingdom ..... 420/581

*Primary Examiner*—Deborah Yee
*Attorney, Agent, or Firm*—Finnegan, Henderson, Farabow, Garrett & Dunner

[57] ABSTRACT

A superalloy with a low thermal expansion coefficient has of 0.1% or less of C, 1.0% of less or Si, 1.0% or less of Mn, 0.5 to 2.5% of Ti, more than 3.0% and not more than 6.0% of Nb, 0.01% or less of B, 20 to 32% of Ni and more than 16% and not more than 30% of Co within a range of $48.8 \leqq 1.235xNi+Co < 55.8$, and the balance essentially Fe except for incidental impurities. The superalloy may further contain 1.0% or less of Al, and has a mean coefficient of thermal expansion of $7.0 \times 10^{-6}$/° C. or less from room temperatures to 400° C., a tensile strength of 100 kgf/mm$^2$ or more at 500° C., and a notch rupture strength superior to a smooth rupture strength in a creep rupture test at 500° C.

9 Claims, No Drawings

SUPERALLOYS WITH LOW THERMAL-EXPANSION COEFFICIENT

FIELD OF THE INVENTION

The present invention relates to superalloys which have excellent high-temperature strength and low coefficients of thermal expansion, and which can be used as composite materials together with ceramics, cemented carbides in gas turbine components.

BACKGROUND OF THE INVENTION

An Fe-36% Ni system alloy of Invar, 42-nickel alloy of Fe-42% Ni system alloy, Koval alloy of Fe-29% Ni-17% Co system alloy, and other types of alloys have hitherto been known as alloys for use as components which require low coefficients of thermal expansion. Though they have low coefficients, these alloys have a low degree of strength at room and elevated temperatures; consequently, they cannot be used as components which require high strength at room and elevated temperatures.

A type of alloy corresponding to Incoloy 903 is disclosed in JP-B-41-2767, and alloys improved over Incoloy 903 are disclosed in JP-A-50-30729, 50-30730, 59-56563, 60-128243, U.S. Pat. No. 4,200,459, etc. These types of alloys are known for their high-temperature strength enhanced by adding precipitation strengthening elements, such as Al, Ti and Nb, and also for their low coefficients of thermal expansion, smaller than those of ordinary austenitic alloys, but much greater than the coefficients of thermal expansion of the initially mentioned alloys.

Alloys disclosed in JP-A-61-23118, 2-70040, etc. have strengths and coefficients of thermal expansion which ar intermediate to those of Incoloy 903-system alloys and Koval-system alloys.

With an increase in operating temperature for gas turbine components, there has been a trend in recent years toward an increasing demand for higher strength materials capable of maintaining a constant clearance between components or members from room to elevated temperatures, and for improvement in the properties of joining metallic materials to materials, having low coefficients of thermal expansion, such as ceramics and cemented carbides Such alloys are used as, for example, collars for joining the rotor shaft of automobile turbochargers with the ceramic blades. The alloys are also used as components of gas turbines, such as compressor housings, exhaust ducts and sealing media; as sleeves for die casting aluminum each composed of a ceramic inner cylinder and an outer cylinder made of a superalloy with a low coefficient of thermal expansion; and as edge tools, as cushioning materials of cemented carbides and alloys, made of cemented carbides utilizing alloys with low thermal expansion.

Incoloy 903 disclosed in JP-B-41-2767 has been put into practical use for such needs. However, it has a high notch-sensitivity at operating temperatures of about 500° C., and there is a marked difference between the notch and the smooth creep rupture strengths at 500° C., thus causing a problem.

The alloys disclosed in JP-A-50-30729, 50-30730, 59-56563, 60-128243, U.S. Pat. No. 4,200,459, etc. mentioned previously are proposed as improved alloys to solve the problem. Of the improved alloys, only Incoloy 909 has been put into practical use. However, although it is superior to Incoloy 903 in notch rupture strength, it has a coefficient of thermal expansion substantially equal to that of Incoloy 903; the thermal expansion is not desirably decreased.

On the other hand, although alloys disclosed in JP-A-61-23118 and 2070040 display coefficients of thermal expansion lower than that of Incoloy 909, these alloys have high-temperature strengths lower than that of Incoloy 909.

In view of the above problems, the object of the present invention is to provide superalloys with low coefficients of thermal expansion which are capable of satisfying the need for the greatest high-temperature strength and the lowest coefficient of thermal expansion of all the conventional superalloys with low thermal expansion.

SUMMARY OF THE INVENTION

To solve the problems mentioned above, the inventor has conducted experiments on Fe-Co-Ni system alloys, and as a result, found Fe-Co-Ni ratios at which the coefficients of thermal expansion can be reduced to the lowest level and appropriate ranges within which Ti, Nb and Al, precipitation strengthening elements, can be added to increase high-temperature strength. This has led to the invention of superalloys satisfying the need for higher strength at a high temperature and low coefficients of thermal expansion.

In accordance with one aspect of this invention, there is provided a superalloy of a low coefficient of thermal expansion comprising, by weight percent: 0.1% or less of C (carbon), 1.0% or less of Si, 1.0% or less of Mn, 0.5 to 2.5% of Ti, more than 3.0% and not more than 6.0% of Nb, 0.01% or less of B (boron), 20 to 32% of Ni and more than 16% and not more than 30% of Co within a range of $48.8<[1.235xNi+Co]<55.8$, and the balance essentially Fe except for incidental impurities.

In accordance with another aspect of this invention, there is provided a superalloy of a low coefficient of thermal expansion comprising, by weight percent: 0.1% or less of C, 1.0% or less of Si, 1.0% or less of Mn, 0.5 to 2.5% of Ti, more than 3.0% and not more than 6.0% of Nb, 0.01% or less of B, 1.0% or less of Al, 20 to 32% of Ni and more than 16% and not more than 30% of Co within a range of $48.8\leqq[1.235xNi+Co]<55.8$, and the balance essentially Fe except for incidental impurities. The superalloy of a low coefficient of thermal expansion has a mean coefficient of thermal expansion of $7.0\times10^{-6}$/° C. or less from the room temperature to 400° C., a tensile strength of 100 kgf/mm$^2$ or more at 500° C., and a notch rupture strength superior to a smooth rupture strength in a creep rupture test at 500° C.

DETAILED DESCRIPTION OF THE INVENTION

The reasons for limiting contents of alloying elements in alloys according to this invention will be set forth below.

Percentages hereinafter used are weight percentages unless otherwise stated.

Carbon combines with Ti and Nb to form carbide as to prevent crystal grains from becoming coarse, and contributes to improving strength. However, when carbon is added in excess of 0.1%, carbides of Ti and Nb are excessively produced. Carbon decreases the amounts of solute Ti and Nb, both of which function as precipitation strengthening elements, and increases the coefficients of thermal expansion of the alloys. Therefore, carbon content should be 0.1% or less.

Silicon is an indispensable element to be added to the invention alloys because it acts as a deoxidizer and promotes precipitation of Laves phase useful in refining the crystal grains and improving the shape of grain boundaries. However, the addition of Si in excess of 1% decreases hot-workability and high-temperature strength; Si content therefore should be limited to 1.0% or less.

Manganese is added as a deoxidizer and is contained in the alloys. It is undesirable for Mn to increase the coefficients of thermal expansion of the alloy when it is added excessively. Manganese content thus should be limited to 1.0% or less.

As mentioned above, first, parts of Ti and Nb combine with carbon to form carbides, and then, as described below, the residual Ti and Nb combine with Ni and Co to form an intermetallic compound, thus strengthening the alloys.

Through an aging treatment of the alloy, Ti, together with Ni, Co and Nb, precipitates fine gamma prime phase particles of several ten nano-meters which consists of $(Ni,Co)_3(Ti,Nb)$, thus remarkably increasing the tensile strength of the alloy at elevated temperatures. Titanium content must be at least 0.5% to increase such a tensile strength. However, when it exceeds 2.5%, it increases the coefficient of thermal expansion but decreases hot-workability. Therefore, Ti content should be limited to 0.5 to 2.5%.

Niobium, like Ti, together with Ni and Co, precipitates gamma prime phase particles through the aging treatment, thus markedly increasing hot strength. A part of niobium precipitates the Laves phase, with a diameter of several microns (μm), within grains and at grain boundaries. Niobium provides crystal grains of appropriate fineness and remarkably increases the strength of grain boundaries, the tensile strength at high temperatures and the notch strength at approximately 500° C. For this reason, Nb content is required to be more than 3.0%, however, when it is added in excess of 6.0%, it increases the coefficient of thermal expansion and decreases hot-workability. Niobium content therefore should be limited to more than 3.0% and not more than 6.0%.

Tantalum is an element belonging to the same group as that of Nb and has an atomic weight twice that of Nb. A part of Nb is replaceable with Ta within a range of $3.0<[Nb+{}^{Ta}{}_2]\leqq 6.0$.

Titanium and niobium are indispensable elements to be added to the invention alloys. Aluminum may also be added as a precipitation strengthening element as well as a stabilizer element for the gamma prime phase. Aluminum, like Ti and Nb, together with Ni and Co, precipitates fine gamma prime phase particles which consists of a face-centered cubic lattice structure of $(Ni,Co)_3(Al,Ti,Nb)$ of several ten nano-meters through the aging treatment, thus increasing the strength at a elevated temperature. However, excessive aluminum decreases hot-workability and increases the coefficient of thermal expansion. Therefore, aluminum content should be limited to 1.0% or less.

Boron segregates at crystal grain boundaries and increases the strength of grain boundaries, thus contributing to improving hot-workability and notch creep rupture strength at a temperature level of 500° C. However, excessive boron, that is 0.01%, forms boride, thereby lowering the liquidus line of the alloys and thus deteriorating hot-workability. Therefore, boron content should be limited to 0.01% or less.

Nickel, together with Co and Fe, forms a matrix. An Fe-Co-Ni ratio has a remarkable effect on the coefficients of thermal expansion of the alloys and the form of precipitates of an intermetallic compound. The invention alloys may contain alloying elements, such as Ti, Nb and Al, in order to obtain a high-temperature strength which is the greatest possible strength of conventional alloys. Because the Fe-Co-Ni ratio which has not been found with the conventional alloys is found in this invention, it becomes possible to obtain a high tensile strength at elevated temperatures and a low coefficient of thermal expansion. In addition, the Laves phase is precipitated at the Fe-Co-Ni ratio of this invention in an amount much greater than that of the conventional alloys, thus contributing to strengthening of crystal grain boundaries and increase the notch creep rupture strength at approximately 500° C.

For this reason, Ni content should be 20% or more. When it is less than 20%, an austenitic phase becomes unstable, causing martensitic transformation, a decrease in hot-temperature strength and an increase in the coefficients of thermal expansion. On the other hand, when Ni content is more than 32%, it increases the coefficients of thermal expansion and decreases the amount of precipitation of the Laves phase which contributes to strengthening of crystal grain boundaries. Nickel content should thus be limited from 20 to 32%.

Cobalt, like Ni, together with Fe, constitutes the matrix, and contributes to decreasing the coefficients of thermal expansion and precipitation of the Laves phase. Cobalt must be added in excess of 16%. When cobalt content is 16% or less, the austenitic phase becomes unstable, causing martensitic transformation, a decrease in high-temperature strength and an increase in the coefficients of thermal expansion. On the other hand, when cobalt is added in excess of 30%, it increases the coefficients, and therefore it should be more than 16% and not more than 30%.

The lowest coefficient of thermal expansion can be obtained depending on the balance between the contents of Ni and Co, and the sum of the two components is a very important value.

As disclosed in JP-B-41-2767, cobalt contributes to lowering the coefficients of thermal expansion at a ratio 1.235 times the ratio at which Ni contributes. The present invention has experimentally investigated this fact and confirmed that Co is 1.235 times more effective than Ni in terms of contributing to lowering the coefficients of thermal expansion. Low coefficients of thermal expansion of the alloys of this invention are within a range lower than the coefficient of thermal expansion of the alloy, containing the sum of 1.235Ni and Co, disclosed in JP-B-41-2767. When the sum of 1.235Ni and Co is 55.8 or more, the coefficients of thermal expansion increase excessively, whereas when it is less than 48.8, martensitic transformation tends to occur easily. Therefore, Ni and Co should be limited to within a range expressed by the following equation.

$$48.8\leqq[1.235Ni+Co]<55.8$$

The alloys of this invention have low coefficients of thermal expansion and high strength at elevated temperatures during aging and solid-solution treatments. When the alloys are used as gas turbine components, joining components of ceramic or cemented carbide, etc. and if the coefficients of thermal expansion of these alloys are more than $7.0\times10^{-6}/°$ C. at temperatures ranging from the room temperature to 400° C., it is impossible to secure clearance and joining strength sufficient for use at elevated temperatures. Therefore, the coefficients of thermal expansion should be limited to $7.0\times10^{-6}/°$ C. or less at the above temperature range.

When tensile strength at 500° C. is less than 100 kgf/mm$^2$, the alloys cannot withstand joining stress, such as shrink fitting or stress during high rotation at elevated temperatures. Thus, tensile strength at 500° C. is limited to 100 kgf/mm$^2$ or more.

In many cases, such superalloys with low coefficients of thermal expansion have several stress concentrations when actually used as products. If the notch strength of the stress concentrations is lower than that of smooth surfaces, the alloys may fracture much earlier than the designed rupture life. This decrease in the notch strength is most acute at approximately 500° C. If a notch portion ruptures earlier than a smooth surface of a material in a combined smooth/notch creep rupture test at approximately 500° C., the conditions under which such a material can be actually used are limited.

It is important for notch rupture strength to be greater than smooth rupture strength in the combined smooth-/notch creep rupture test at 500° C., and for the material not to rupture at the notch portion thereof.

Table 1 shows chemical compositions of the conventional alloys and the invention alloys. The invention and conventional alloys were melted in a vacuum induction melting furnace and formed into ingots of 10 kg. Then the alloys were maintained at 1150° C. for 20 hours, a homogenizing treatment; forged at a heating temperature of 1100° C.; and formed into square samples of 30 mm. Thereafter, all the alloys, except for conventional alloy No. 11, were subjected to a solution treatment in which these alloys were maintained at 982° C. for one hour and then air cooled. Alloy No. 11 was subjected to another solution treatment in which it was maintained at 930° C. for 1 hour and then air cooled. All the alloys were subjected to a two-state aging treatment in which the alloys were first maintained at 720° C. for 8 hours and cooled to 620° C. at a cooling rate of 55° C./hr, and then maintained at 620° C. for 8 hours and air cooled.

TABLE 1

| | | Chemical Composition (wt %) | | | | | | | | | | |
|---|---|---|---|---|---|---|---|---|---|---|---|---|
| Type | No. | C | Si | Mn | Ni | Co | Al | Ti | Nb | B | Fe | 1.235 Ni + Co |
| Invention Alloy | 1 | 0.03 | 0.45 | 0.19 | 25.7 | 23.0 | — | 1.53 | 4.71 | 0.004 | Bal. | 54.7 |
| | 2 | 0.04 | 0.03 | 0.21 | 30.3 | 16.9 | — | 1.33 | 5.21 | 0.005 | Bal. | 54.3 |
| | 3 | 0.07 | 0.40 | 0.26 | 26.6 | 20.2 | — | 1.36 | 5.04 | 0.007 | Bal. | 53.1 |
| | 4 | 0.05 | 0.88 | 0.32 | 25.9 | 22.4 | — | 1.57 | 4.66 | 0.006 | Bal. | 54.3 |
| | 5 | 0.05 | 0.43 | 0.91 | 25.1 | 22.7 | — | 1.61 | 4.33 | 0.005 | Bal. | 53.6 |
| | 6 | 0.03 | 0.46 | 0.36 | 22.1 | 27.2 | — | 1.41 | 4.20 | 0.004 | Bal. | 54.5 |
| | 7 | 0.04 | 0.18 | 0.28 | 23.9 | 23.0 | — | 2.23 | 4.74 | 0.005 | Bal. | 52.5 |
| | 8 | 0.05 | 0.02 | 0.15 | 27.3 | 19.9 | 0.52 | 0.97 | 4.75 | 0.004 | Bal. | 53.6 |
| | 9 | 0.03 | 0.44 | 0.30 | 25.8 | 23.0 | 0.57 | 1.30 | 4.08 | 0.004 | Bal. | 54.9 |
| | 10 | 0.08 | 0.24 | 0.35 | 25.6 | 21.2 | 0.81 | 1.87 | 3.81 | 0.007 | Bal. | 52.8 |
| Conventional Alloy | 11 | 0.03 | — | — | 38.0 | 15.0 | 0.85 | 1.42 | 2.96 | — | Bal. | 61.9 |
| | 12 | 0.04 | 0.46 | 0.01 | 38.0 | 13.2 | 0.03 | 1.52 | 4.71 | — | Bal. | 60.1 |
| | 13 | 0.03 | 0.12 | — | 26.4 | 22.5 | 0.08 | 0.05 | 6.06 | — | Bal. | 55.1 |

Conventional alloy No. 11 is an alloy corresponding to Incoloy 903; alloy No. 12 is an alloy corresponding to Incoloy 909; and alloy No. 13 is an alloy disclosed in JP-A-2-70040. All the alloys of this invention and the conventional alloys Nos. 12 and 13, but not alloy No. 11, were subjected to the same standard heat treatment as that used for Incoloy 909 corresponding to conventional alloy No. 12.

Since conventional alloy No. 11, corresponding to Incoloy 903, has a low recrystallization temperature which causes the crystal grains to grow easily, it was subjected to a solution treatment at a temperature of 930° C. lower than that used for the other alloys.

TABLE 2

| | | Tensile Properties at Room Temp. | | Tensile Properties at 500° C. | | Combined Smooth/Notch Creep Rupture Properties | | | | Coefficient of Thermal |
|---|---|---|---|---|---|---|---|---|---|---|
| Type | No. | Tensile Strength (kgf/mm$^2$) | Elongation (%) | Tensile Strength (kgf/mm$^2$) | Elongation (%) | Initial Stress (kgf/mm$^2$) | Rupture Stress (kgf/mm$^2$) | Rupture Life (hr) | Elongation (%) | Expansion $\alpha_{30-400}$ ($\times10^{-6}$/°C.) |
| Invention Alloy | 1 | 140.4 | 22.3 | 110.3 | 14.3 | 80 | 105 | 261 | 10.6 | 6.65 |
| | 2 | 135.2 | 18.1 | 114.0 | 12.5 | 80 | 105 | 268 | 8.5 | 5.91 |
| | 3 | 138.8 | 19.2 | 112.4 | 13.9 | 80 | 105 | 255 | 9.6 | 6.03 |
| | 4 | 136.4 | 18.5 | 109.4 | 15.3 | 80 | 104 | 260 | 10.1 | 6.58 |
| | 5 | 137.9 | 17.9 | 110.2 | 15.0 | 80 | 104 | 251 | 8.8 | 6.49 |
| | 6 | 145.1 | 23.1 | 108.3 | 17.2 | 80 | 100 | 248 | 11.1 | 6.21 |
| | 7 | 155.0 | 19.2 | 112.5 | 15.6 | 80 | 105 | 270 | 8.6 | 6.72 |
| | 8 | 134.4 | 18.9 | 111.7 | 16.6 | 80 | 100 | 249 | 8.3 | 5.94 |
| | 9 | 137.2 | 17.3 | 110.5 | 13.1 | 80 | 105 | 266 | 9.3 | 6.16 |
| | 10 | 139.5 | 19.4 | 113.6 | 14.8 | 80 | 105 | 259 | 9.8 | 6.20 |
| Conventional Alloy | 11 | 134.5 | 21.1 | 114.1 | 20.3 | 50 | 50 | 10.3 | N | 7.79 |
| | 12 | 127.5 | 14.8 | 110.5 | 15.4 | 80 | 100 | 246 | 12.3 | 7.95 |
| | 13 | 90.2 | 22.1 | 73.3 | 20.1 | 50 | 80 | 304 | 22.8 | 6.65 |

Table 2 shows tensile properties at normal temperatures and at 500° C., combined smooth/notch creep rupture properties at 500° C., and the mean coefficient of thermal expansion at temperatures ranging from 30° to 400° C. A reduced specimen A370 having a parallel portion of 6.35 mm diameter and a distance of 25.4 mm between marks was used as a tensile specimen. A tensile test was conducted using the ASTM testing method at normal temperatures and at 500° C. Test specimen No. 9 of A453, having smooth and notch portions of a diameter of 4.52 mm and a distance of 18.08 mm between marks on the smooth portion, was used in a combined smooth/notch creep rupture test. This creep rupture test was conducted using the ASTM method under conditions where the testing temperature was 500° C., and an initial stress of 50 kgf/mm$^2$ was applied only to alloys Nos. 11 and 13, and an initial stress of 80 kgf/mm$^2$ to the other alloys. Alloys which did not rupture in the period of up to 200 hours were given a stress of 5 kgf/mm$^2$ every 8 to 16 hours thereafter until the alloys were ruptured forcibly.

Table 2 also shows the total amount of test time (indicated in the rupture life column) which is the time from when the initial stress is applied until the final stress leading to rupture is applied (indicated in the rupture stress column). Elongation values are shown in the elongation columns when alloys rupture at the smooth portions, and symbol "N" is shown in the same columns when alloys rupture at the notch portions. A test specimen with a diameter of 5 mm and a length of 19.5 mm was used to determine the mean coefficient of thermal expansion at temperatures ranging from 30° to 400° C.

As can be seen from Tables 1 and 2, all the alloys of this invention have excellent tensile strength at 500° C. and at room temperatures; have a notch strength greater than the strength of the smooth portion when the alloys are ruptured at the smooth portions thereof in the combined smooth/notch creep rupture test at 500° C.; and have greater rupture stress. In addition, all the alloys have a mean coefficient of thermal expansion of $7.0\times10^{-6}$/° C. or less from normal temperatures to 400° C.

On the other hand, conventional alloy No. 11 (Incoloy 903) can manifest tensile strength a 500° C. and at room temperatures substantially equal to that of the invention alloys. Alloy No. 11, however, has an extremely low notch strength at 500° C. and has a coefficient of thermal expansion which is higher by 20% or more (not weight percent) than the coefficients of thermal expansion of the alloys of this invention. The reason that Incoloy 903 has an abnormally high notch sensitivity appears to be that the Nb content is relatively low and Incoloy 903 does not form a structure sufficient for precipitating the Laves phase of Fe, Co, Ni and Nb, with the result that the strength of the grain boundaries is not thoroughly retained.

Conventional alloy No. 12 (Incoloy 909) is an alloy prepared by decreasing the Al content and increasing the Nb content in Incoloy 903. Even at the same Fe-Co-Ni ratio, the Laves phase precipitates and the notch rupture strength of alloy No. 12 increases. However, no decrease in the coefficient of thermal expansion of alloy No. 12 can be observed because the Fe-Co-Ni ratio in alloy No. 12 is the same as that of Incoloy 903 and thus alloy No. 12 has a high "1.235Ni+Co" value. Alloy No. 12 displays a coefficient of thermal expansion greater than those of the alloys according to this invention.

Compared with the alloys of this invention, alloy No. 13 has a "1.235Ni+Co" value which falls within the range of the alloys according to this invention, and therefore displays a favorable coefficient of thermal expansion. However, alloy No. 13 contains a small amount of Ti, which is a precipitation strengthening element, resulting in incomplete age hardening. Also it has a tensile strength which is apparently inferior to that of the alloys of this invention.

When the alloys of this invention are used as gas turbine components, members joined with ceramics or cemented carbides, etc., they are capable of simultaneously satisfying the need for a high strength at a high-temperature and low thermal expansion, both of which properties cannot be obtained with the conventional alloys. The alloys of this invention can be applied to structural materials which require great strength and maintain a constant clearance between the members or components from normal to elevated temperatures. Also, the alloys of this invention can be reliably joined to materials of low thermal expansion, such as ceramics and cemented carbides, which serve as replacement for structural steel, and the alloys provide high strength.

What is claimed is:

1. A superalloy with a low thermal expansion coefficient consisting essentially of, by weight percent: 0.1% or less of carbon, 1.0% or less of Si, 1.0% or less of Al, 1.0% or less of Mn, 0.5 to 2.5% of Ti, Nb part of which can be substituted by Ta to satisfy 3.0% $<$(Nb+0.5 Ta) $\leqq$6.0% $>$0 to 0.01% of boron, 20 to 32% of Ni and more than 16% and not more than 30% of Co within a range of 48.8% $\leqq$(1.235 Ni+Co) $<$55.8%, and the balance essentially Fe except for incidental impurities, the superalloy having a mean coefficient of thermal expansion of $7.0\times10^{-6}$/° C. or less from room temperature to 400° C.

2. The superalloy with a low thermal expansion coefficient according to claim 1, having about 0.52 wt % or more of Al.

3. The superalloy with a low thermal expansion coefficient according to claim 1 or 2 having a tensile strength of 100 kgf/mm$^2$ or more at 500° C., and a notch rupture strength superior to a smooth rupture strength in a creep rupture test at 500° C.

4. The superalloy with a low thermal expansion coefficient according to claim 1, having at least about 0.004 wt % of boron.

5. The superalloy with a low thermal expansion coefficient according to claim 1, having no more than 1.87 wt % Ti.

6. A superalloy with a low thermal expansion coefficient consisting essentially of, bu weight percent: 0.1% or less of carbon 1.0% or less of Si, 1.0% or less Al, 1.0% or less of Mn, 0.5 to 1.87% of Ti, Nb part of which can be substituted by Ta to satisfy 3.0% $<$(Nb+0.5 Ta)$\leqq$6.0%, 0.01% or less of boron, 20 to 32% of Ni and more than 16% and not more than 30% of Co within a range of 48.8% $\leqq$(1.235xNi+Co)$<$55.8%, and the balance essentially Fe except for incidental impurities, the superalloy having a mean coefficient of thermal expansion of $7.0\times10^{-6}$/° C. or less from room temperature to 400° C.

7. The superalloy with a low thermal expansion coefficient according to claim 6, having about 0.52 wt % or more of Al.

8. The superalloy with a low thermal expansion coefficient according to claim 6 or 7, having a tensile strength of 100 kgf/ mm$^2$ or more at 500° C., and a notch rupture strength superior to a smooth rupture strength in a creep rupture test at 500° C.

9. The superalloy with a low thermal expansion coefficient according to claim 6, having at least about 0.004 wt % of boron.

* * * * *

UNITED STATES PATENT AND TRADEMARK OFFICE

CERTIFICATE OF CORRECTION

PATENT NO. : 5,192,497
DATED : March 9, 1993
INVENTOR(S) : KOJI SATO

It is certified that error appears in the above-identified patent and that said Letters Patent is hereby corrected as shown below:

Claim 1, column 8, line 23, after ≤ 6.0%", insert --,--;

Claim 6, column 8, line 45, "bu" should read --by--;

In the Abstract, line 2, delete "of" (first occurrence), change "of" to --or-- (third occurrence).

Signed and Sealed this

Sixteenth Day of November, 1993

Bruce Lehman

*Attest:*

BRUCE LEHMAN

*Attesting Officer*

*Commissioner of Patents and Trademarks*